United States Patent [19]

Coultrup et al.

[11] Patent Number: 4,804,064

[45] Date of Patent: Feb. 14, 1989

[54] ADJUSTABLE, COLLAPSIBLE SAWHORSE

[75] Inventors: Thomas Coultrup, Santa Ana; James E. Wessling, El Toro, both of Calif.

[73] Assignee: Variety International, Inc., Irvine, Calif.

[21] Appl. No.: 84,989

[22] Filed: Aug. 13, 1987

[51] Int. Cl.[4] ..... B27B 21/00; B25H 1/06

[52] U.S. Cl. ..... 182/155; 182/183; 182/184

[58] Field of Search ..... 182/155, 153, 181–186, 182/224–226; D25/67

[56] References Cited

U.S. PATENT DOCUMENTS

| | | | |
|---|---|---|---|
| 67,347 | 7/1867 | Reef | 182/155 |
| D. 176,419 | 12/1955 | Lowe et al. | D25/67 |
| D. 192,700 | 5/1962 | O'Connor | D25/67 |
| D. 279,606 | 7/1985 | Merians | D25/67 |
| D. 280,440 | 9/1985 | Gromer, Jr. | D25/67 |
| 812,344 | 2/1906 | Howser . | |
| 933,650 | 9/1909 | Kramer | 182/155 |
| 1,576,583 | 3/1926 | England | 182/183 |
| 1,719,440 | 7/1929 | Nathan | 182/181 |
| 2,325,592 | 8/1943 | Degler | 182/183 |
| 2,473,388 | 6/1949 | Rambo | 182/178 |
| 2,583,786 | 1/1952 | Marzucco | 182/181 |
| 2,586,724 | 2/1952 | Sannebeck | 108/146 |
| 2,825,606 | 3/1958 | Rebensdorf | 182/153 |
| 3,817,349 | 6/1974 | Barthel | 182/155 |
| 4,375,245 | 3/1983 | Schill . | |
| 4,605,099 | 8/1986 | Crum et al. | 182/155 |

FOREIGN PATENT DOCUMENTS

| | | | |
|---|---|---|---|
| 2440174 | 7/1980 | France | 108/146 |

*Primary Examiner*—Reinaldo P. Machado
*Attorney, Agent, or Firm*—Morland C. Fischer

[57] ABSTRACT

A lightweight sawhorse which may be easily collapsed in three transversely aligned directions to form a compact, portable package and thereby facilitate the transport and storage thereof. The dimensions of the sawhorse may also be selectively adjusted to adapt the sawhorse to be used at a variety of job sites and supported upon an irregular or non-planar surface. More particularly, the respective lengths of each of the legs of the sawhorse may be adjusted independently of one another. Moreover, the length of the cross member which extends between opposing pairs of the sawhorse legs may also be adjusted. What is more, each of the sawhorse legs may be rotated independently of one another through an arc between a generally vertical position to a generally horizontal position below the cross member.

10 Claims, 2 Drawing Sheets

ADJUSTABLE, COLLAPSIBLE SAWHORSE

BACKGROUND OF THE INVENTION

1. Field of the invention

This invention relates to an adjustable sawhorse which may be collapsed in three transversely aligned directions to form a compact package which may be easily transported and efficiently stored, both at home and at the job site.

2. Prior art

Sawhorses have long been known for providing a flat, generally horizontal surface by which to support a board, or the like. A pair of sawhorses are often arranged opposite one another and a flat board is laid atop the respective cross members thereof to permit the board to be cut, painted, or treated. However, the conventional sawhorse is usually a cumbersome device comprising opposite pairs of rigid legs and a solid cross members extending horizontally therebetween. As a consequence of the large and bulky nature thereof, the conventional sawhorse is not easily transported by hand or by automobile. Moreover, the conventional sawhorse typically consumes a large amount of space, such that storage of a plurality of sawhorses is especially difficult and inefficient.

What is still more, the sawhorse may be needed at a job site which is characterized by a narrow work area or an irregular, non-planar work surface, including steps, or the like. Because of its rigid structure and lack of adjustability, the conventional sawhorse may be impractical or undesirable at such work sites where space is limited and/or the ground upon which the sawhorse rests is neither flat nor horizontal.

Sawhorses are known which have a limited capacity to be collapsed or adjusted. Examples of such sawhorses are provided by the following U.S. patents: U.S. Pat. No. 812,344, Feb. 13, 1906; U.S. Pat. No. 933,650, Sept. 9, 1909; U.S. Pat. No. 2,325,592, Aug. 3, 19 U.S. Pat. No. D 192,700, May 1, 1962; U.S. Pat. No. D 279,606, July 9, 1985; U.S. Pat. No. D 280,440, Sept. 3, 1985. However, no one of the above-mentioned sawhorses can be collapsed or adjusted in three transversely aligned directions. Therefore, the sawhorses retain much of their large size and remain generally unsuitable to be hung from a wall or stored on a shelf or other area where space is limited.

SUMMARY OF THE INVENTION

Briefly, a lightweight sawhorse is disclosed which may be collapsed or folded in three transversely directions to form a compact package suitable for convenient transport and efficient storage. The sawhorse comprises first and second oppositely disposed pairs of legs and a cross member extending horizontally therebetween. Each of the legs includes an inner tube surrounded by an outer sleeve. The inner tube is slideable through the outer sleeve in a first of said three directions, so that the length of each leg can be adjusted independently of the other legs. A button is biased by a spring clip so as to be removably received through respective holes formed in the inner tube and outer sleeve, whereby the position of the inner tube may be fixed relative to the outer sleeve. The button is removable from the hole in the outer sleeve, against the bias of the spring clip, to permit the position of the inner tube to be changed relative to the outer sleeve.

The cross member of the sawhorse includes an inner rail and an outer rail which surrounds the inner rail. The inner rail is slidable through the outer rail in a second of the three directions, so that the length of the cross member may be selectively adjusted. A button is biased by a spring clip so as to be removably received through respective holes formed in the inner and outer rails, whereby the position of the inner rail may be fixed relative to the outer rail. The button is removable from the hole in the outer rail, against the bias of the spring clip, to permit the position of the inner rail to be changed relative to the outer rail.

An end bracket is located at each end of the cross member. Each of the legs of the sawhorse is pivotally connected to one side of a respective end bracket. Accordingly, the legs may be rotated independently of one another, in the third of the three directions, through an arc from a vertical position in substantially perpendicular alignment with the cross member to a horizontal position in substantially parallel alignment with the cross member.

DESCRIPTION OF THE PREFERRED EMBODIMENT

Figure 1:
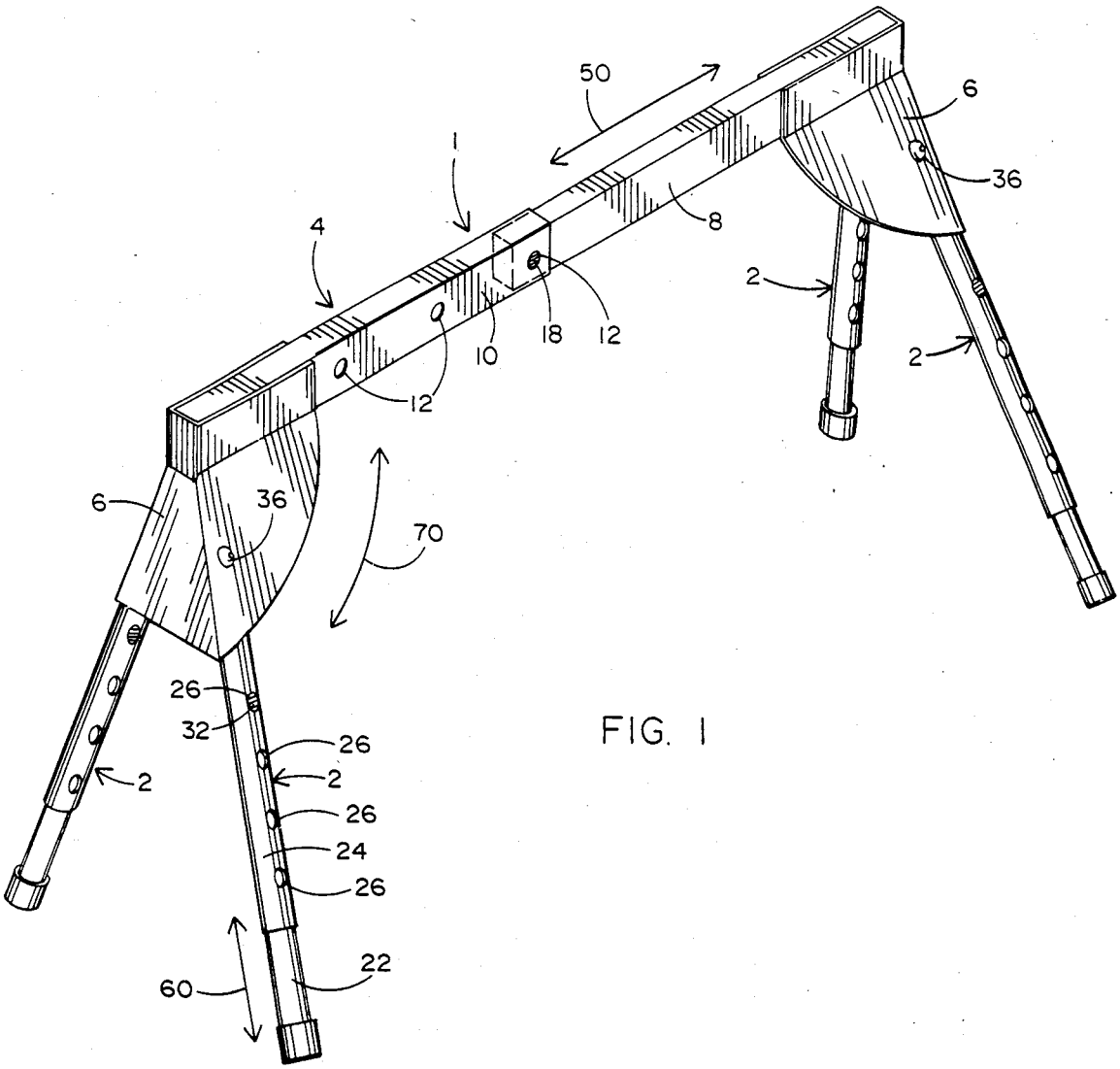
FIG. 1 is an isometric view of an adjustable, collapsible sawhorse which forms the present invention.

The adjustable and collapsible sawhorse which forms the present invention is best described while referring to the drawings. As with many conventional sawhorses, the sawhorse 1 of FIG. 1 includes four generally vertical legs 2 and a horizontal cross member 4. Pairs of legs 2 are disposed at opposite ends of the sawhorse 1 to support the cross member 4 therebetween. Each pair of legs 2 is interconnected with one end of the cross member 4 by means of a respective end bracket 6, the details of which will be described in greater detail hereinafter.

However, unlike any known sawhorses, the sawhorse 1 of the present invention may be adjusted or folded in three transversely aligned directions, so as to form a compact, portable package, which may be easily transported and conveniently stored, both at home or on the job. More particularly, and referring concurrently to FIGS. 1 and 2 of the drawings, the cross member 4 comprises inner and outer concentrically aligned rails 8 and 10 which are adapted to slide along one another in order to selectively adjust the length of the cross member. Each rail 8 and 10 is preferably formed from a lightweight metal, such as as aluminum, or the like. Moreover, each rail 8 and 10 is preferably formed with a hollow, rectangular cross-section to permit the inner rail 8 to be received within and slide through the outer rail 10. However, it is to be understood that the particular shape and material described above for rails 8 and 10 are for purposes of example only, and other suitable shapes and lightweight materials may be substituted therefor.

Figure 2:
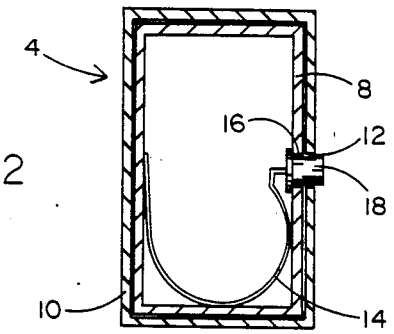
FIG. 2 is a cross-section of the cross member of the sawhorse of FIG. 1.

As is best shown in FIG. 1, the outer rail 10 is provided with a plurality (e.g. three) of evenly spaced and longitudinally aligned holes 12 formed through one side thereof. As is best shown in FIG. 2, a single hole 16 is formed through a side of inner rail 8, such that the hole 16 of inner rail 8 will coincide with successive ones of the holes 12 of outer rail 10 as the inner rail 8 is moved through the outer rail 10. As is also best shown in FIG. 2, a resilient, spring clip 14 is located in the hollow interior of inner rail 8. A button 18 is affixed to one end of spring clip 14 to be normally biased for receipt through the hole 16 of inner rail 8. The normal bias of spring clip 14 also causes button 18 to be automatically and removably received through one of the holes 12 of the outer rail 10 as the inner rail 8 is moved through the outer rail 10 until a pair of the holes 12 and 16 coincide with one another. A receipt of the button 18 through holes 12 and 16 provides a temporary locking feature to preserve the positions of inner and outer rails 8 and 10 relative to one another and maintain a particular length of cross member 4 between opposite pairs of legs 2.

Of course, the length of cross member 4 may be easily adjusted (lengthened or shortened) by first removing the button 18 from a corresponding hole 12 of outer rail 10 through which said button extends. That is to say, the button 18 is depressed against the normal bias of spring clip 14. With the button 18 pushed inwardly and removed from one of the holes 12 of outer rail 10, the user may slide the inner rail 8 (in either of the directions indicated by the reference arrows designated 50) relative to outer rail 10 until the button 18 is automatically received through another hole 12 in the outer rail 10. Thus, the receipt of the button 18 through a different hole 12 of outer rail 10 preserves the new positions of the inner and outer rails 8 and 20 relative to one another and maintains a correspondingly new length of cross member 4 between opposite pairs of legs 2.

Figure 5:
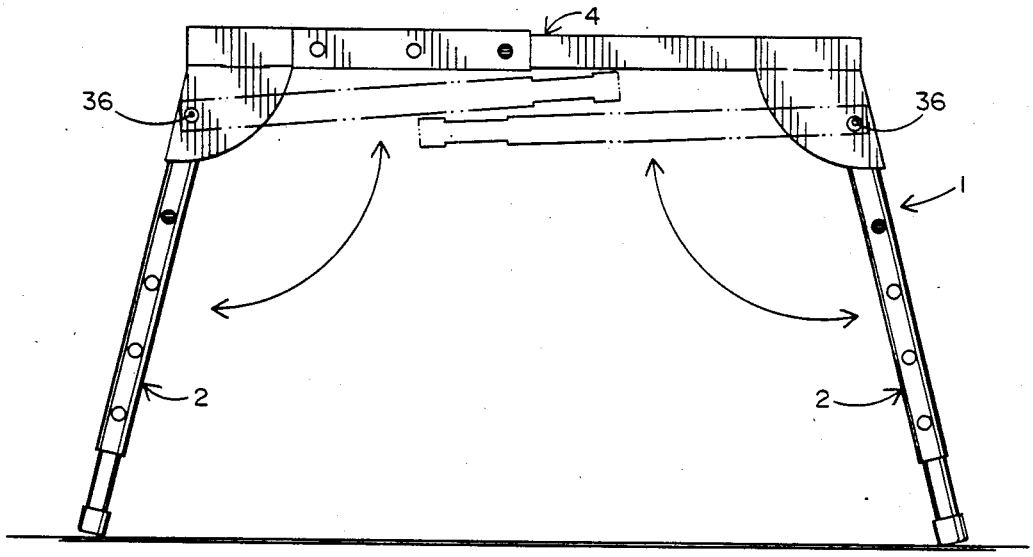
FIG. 5 is a front view of the sawhorse with the legs adjusted to their minimum lengths and the cross member adjusted to its maximum length.

The length of cross member 4 may be adjusted as often as is desired or necessary by first removing the button 18 from one of the holes 12 of outer rail 10 and then sliding the inner rail 8 through outer rail 10 until the button 18 is received within a different hole. By way of example, FIGS. 1 and 5 show the cross member 4 of sawhorse 1 extending to its maximum length between opposite pairs of legs 2, while FIG. 4 of the drawings shows the inner rail 8 moved inwardly through the interior of outer rail 10 so that the cross member 4 is adjusted to its minimum length.

Referring once again to FIG. 1, each of the legs 2 of sawhorse 1 comprises an inner tube 22 and an outer concentrically aligned sleeve 24. The inner tube 22 and outer sleeve 24 are preferably formed from aluminum or other lightweight metal, and have a hollow construction, so that inner tube 22 is adapted to slide through one end of the hollow interior of outer sleeve 24, whereby the length of each leg 2 may be selectively adjusted. The outer sleeve 24 is provided with a plurality (e.g. four) of evenly spaced and longitudinally aligned holes 26 formed through opposite sides thereof.

Figure 3:
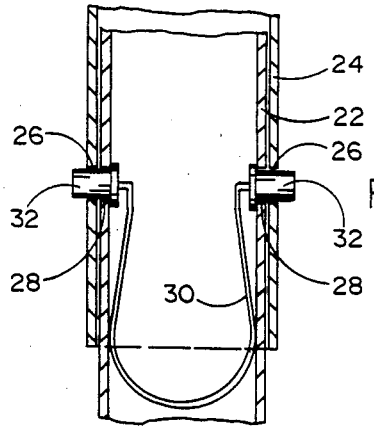
FIG. 3 is a cross-section of a leg of the sawhorse of FIG. 1.

As is best shown in FIG. 3, a single hole 28 is formed through opposite sides of inner tube 22, such that the holes 28 of inner tube 22 will coincide with successive pairs of opposing holes 26 of outer sleeve 24 as the inner tube 22 is moved through the outer sleeve. As is also best shown in FIG. 3, a resilient, U-shaped spring clip 30 is located within the hollow interior of inner tube 22. A button 32 is affixed to each end of the spring clip 30. Each button 32 is normally biased for receipt through a respective hole 28 of inner tube 22. The normal bias of spring clip 30 also causes buttons 32 to be automatically and removably received through respective pairs of opposing holes 26 of outer sleeve 24 as the inner tube 22 is moved through the outer sleeve 24 until one of the pairs of holes 26 of outer sleeve 24 coincides with a pair of holes 28 of inner tube 22. A receipt of button 32 through holes 28 and 26 provides a temporary locking feature to preserve the position of inner tube 22 relative to outer sleeve 24 and maintain a particular length of leg 2 for raising the cross member 4 (of FIG. 1) above the ground or other support surface.

The length of each leg 2 may be easily adjusted (lengthened or shortened) independently of the other legs by first removing the buttons 32 from a corresponding pair of holes 26 of outer sleeve 24 through which such buttons extend. That is to say, the buttons 32 are depressed in opposite directions relative to one another against the normal bias of spring clip 30. With the buttons pushed inwardly and removed from respective ones of the holes 26 of outer sleeve 24, the user may slide the inner tube 22 (in either of the directions indicated by the reference arrows 60 of FIG. 1) relative to outer sleeve 24 until the buttons 32 are automatically received through other holes 26 of outer sleeve 24. The receipt of buttons 32 through a respective pair of holes 26 of outer sleeve 24 preserves the new position of the inner tube 22 relative to the outer sleeve 24 and maintains a correspondingly new length of the leg 2 between the cross member 4 and the ground.

Figure 4:
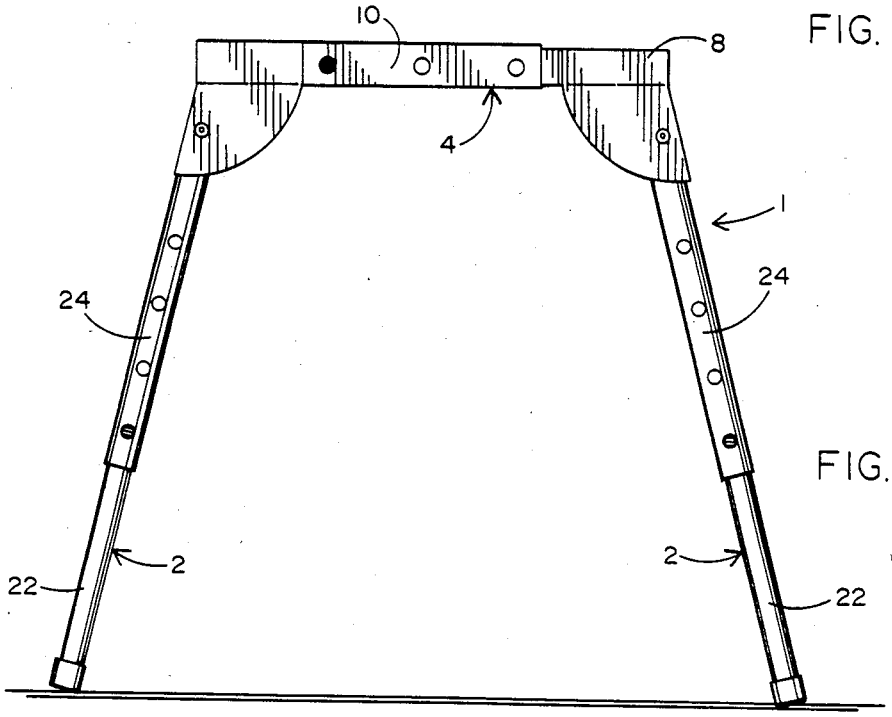
FIG. 4 is a front view of the sawhorse with the legs adjusted to their maximum lengths and the cross member adjusted to its minimum length.

As may be appreciated, the length of any one or all of the legs 2 of sawhorse 1 may be selectively adjusted as often as is desired or necessary by first removing the buttons 32 from a corresponding pair of holes 26 of outer sleeve 24 and then sliding the inner tube 22 through the outer sleeve 24 until the buttons 32 are received within a different pair of holes 26. In this manner, the lengths of one or more legs 2 may be adjusted to accommodate steps or non-planar and irregular surfaces on which said legs will rest to maintain a horizontal elevation of cross member 4. By way of example, FIGS. 1 and 5 show each of the legs 2 of sawhorse 1 adjusted to its minimum length relative to cross member 4, while FIG. 4 shows the inner tube 22 moved outwardly through the interior of outer sleeve 24 so that each leg 2 is adjusted to its maximum length.

What is more, although the inner tube 22 and outer sleeve 24 have been described as having pairs of holes 26 and 28 formed at opposite sides thereof, it should be understood that holes may, in the alternative, be formed through one side only. However, pairs of opposing holes are preferred so as to avoid an unintentional change in the length of a leg 2 of sawhorse 1. That is, and as previously disclosed, equal and opposite forces must first be applied to the buttons 32 of FIG. 3 before the buttons can be depressed and removed from the holes 26 in the outer sleeve 24, whereby to permit the inner tube 22 to be moved through outer sleeve 24. In the event that only one of the buttons 32 is depressed (such as when a board inadvertently strikes one side of a leg 2), the second button 32 will continue to extend through a hole 26 at the opposite side of leg 2 to preserve the position of inner tube 22 relative to outer sleeve 24 and maintain the horizontal elevation of cross member 4.

Figure 6:
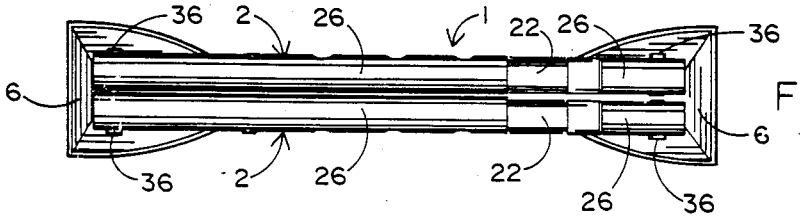
FIG. 6 is a bottom view of the sawhorse in the fully collapsed condition.

As just described, the inner tube 22 of each leg 2 of sawhorse 1 may slide through one end of the outer sleeve 24. Referring concurrently to FIGS. 1 5 and 6 of the drawings, the opposite end of each outer sleeve 24 is shown pivotally connected to an end bracket 6. More particularly, each end bracket 6 comprises a pair of side plates coextensively connected to an end plate. A rivet 36, or the like, connects each outer sleeve 24 to a respective side plate of an end bracket 6, so that any one or all of the legs 2 may be selectively rotated independently of the other legs through an arc in a direction indicated by the reference arrows 70 of FIG. 1. Thus, and as depicted in FIG. 5, the legs 2 of sawhorse 1 may be lowered to the vertical position in substantially perpendicular alignment with the horizontal cross member 4 when it is desirable to use sawhorse 1 to support a weight upon the cross member. The legs 2 are moved into contact with the back plates of brackets 6 when being lowered to the vertical position. Or, the legs 2 may be raised (i.e., rotated around pivot 36) to the horizontal position (shown in phantom) in substantially parallel alignment with and located immediately below cross member 4 when it is desirable to fold sawhorse 1 into a compact package suitable for transport and/or storage.

As is best shown in FIG. 6, it is preferably that the upper end of each of the legs 2 of sawhorse 1 lie in close proximity to and engage the side plate of the end bracket 6 to which such leg is pivotally attached. The resulting friction fit established between the legs 2 and their respective end brackets 6 will automatically retain the legs in the lowered, vertical or raised, horizontal positions without requiring the additional use of clamps, latches or other retaining means.

Figure 7:
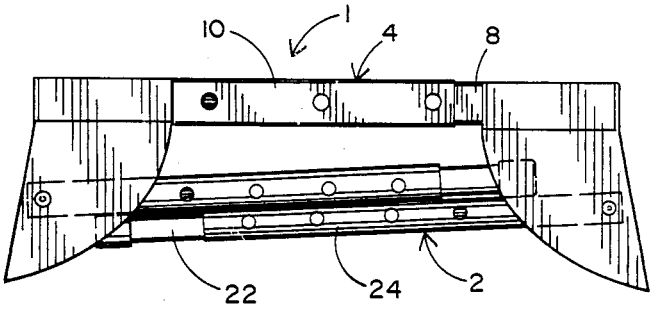
FIG. 7 is a front view of the sawhorse in the fully collapsed condition.

It should now be apparent that by virtue of the present invention, an adjustable sawhorse 1 is available which may be conveniently folded or collapsed in three transversely aligned directions (represented by the reference arrows 50, 60 and 70 of FIG. 1), so as to form a compact, easily portable package which is ideal for transport and/or storage. The sawhorse 1 is shown in FIGS. 6 and 7 of the drawings in the fully folded/collapsed condition. More particularly, the inner and outer rails 8 and 10 are moved towards one another so as to minimize the length of cross member 4. The inner tubes 22 are moved inwardly through the outer sleeves 24, so as to minimize the lengths of each of the legs 2. Lastly, the legs 2 are rotated from a generally vertical position to a generally horizontal position below cross member 4. The result of the foregoing is to reduce the overall size of the sawhorse 1 to be easily transported by hand or in the cab of a vehicle and stored on a shelf or on a wall at a storage site. Of course, the user is free to avail himself of any combination of the aforementioned three degrees of adjustment, depending upon whether the sawhorse is being transported, stored, or used at the job site.

It will be apparent that while a preferred embodiment of the invention has been shown and described, various modifications and changes may be made without departing from the true spirit and scope of the invention.

Having thus set forth a preferred embodiment of the invention, what is claimed is:

1. An adjustable sawhorse which is collapsible in three transversely aligned directions to form a compact package suitable for transport and storage, said sawhorse comprising:

first and second pairs of legs, each of said legs comprising an inner tube and an outer sleeve, said inner tube being movable through said outer sleeve to adjust the length of a respective leg;

a cross member extending between said first and second pairs of legs, said cross member comprising an inner and an outer member, said inner member being movable through said outer member to adjust the length of said cross member between said pairs of legs; and means to rotate said legs in a third direction through an arc from a vertical position to a substantially horizontal position.

2. The sawhorse recited in claim 1, further comprising means to pivotally connect said first and second pairs of legs to respective ends of said cross member such that said legs are rotatable in said third direction from the vertical to the horizontal position.

3. The sawhorse recited in claim 1, wherein the outer sleeve of each leg has a plurality of longitudinally aligned holes formed therethrough and the inner tube of each leg has at least one hole formed therethrough, said sawhorse further comprising means to be removably received through a hole of said outer sleeve and the hole in said inner tube for fixing the position of said inner tube relative to said outer sleeve.

4. The sawhorse recited in claim 3, wherein said removably received means includes a resilient spring located at the interior of the inner tube of each leg and having a button affixed to one end thereof, the normal bias of said spring forcing said button to be removably received through the respective holes of said inner tube and said outer sleeve.

5. The sawhorse recited in claim 4, wherein said button extends outwardly from the hole of said outer sleeve to a manually accessible location, a depression of said button against the normal bias of said spring forcing said button inwardly through the hole of said outer sleeve to permit the position of said inner tube to be changed relative to said outer sleeve.

6. The sawhorse recited in claim 1, further comprising an end bracket connected to each end of said cross member and means to pivotally connect said pairs of legs to respective end brackets to permit said legs to be rotated from the vertical to the horizontal position.

7. The sawhorse recited in claim 6, wherein said end bracket includes a pair of side plates and an end plate, each leg being pivotally connected to a respective side plate of an end bracket, and each pair of legs engaging a respective end plate of an end bracket to limit the rotational movement of said legs.

8. The sawhorse recited in claim 1, wherein the outer member of said cross member has a plurality of longitudinally aligned holes formed therethrough and the inner member of said cross member has at least one hole formed therethrough, said sawhorse further comprising means to be removably received through a hole of said outer member and the hole of said inner member for fixing the position of said inner member relative to said outer member.

9. The sawhorse recited in claim 8, wherein said removably received means includes a resilient spring located at the interior of said inner member and having a button affixed. to one end thereof, the normal bias of said spring forcing said button to be removably received through the respective holes of said inner and outer members.

10. The sawhorse recited in claim 9, wherein said button extends outwardly from the hole of said outer member to a manually accessible location, a depression of said button against the normal bias of said spring forcing said button inwardly through the hole of said outer member to permit the position of said inner member to be changed relative to said outer member.

* * * * *